US005432598A

United States Patent [19]

Szatkowski

[11] Patent Number: 5,432,598

[45] Date of Patent: Jul. 11, 1995

[54] APPARATUS FOR LASER ASSISTED FIREARM SIGHTS ALIGNMENT

[76] Inventor: David Szatkowski, 10469 Sioux River Cir., Fountain Valley, Calif. 92708

[21] Appl. No.: 219,276

[22] Filed: Mar. 29, 1994

[51] Int. Cl.[6] ..... F41G 1/54

[52] U.S. Cl. ..... 356/153; 33/234

[58] Field of Search ..... 356/138, 153; 33/234, 33/286

[56] References Cited

U.S. PATENT DOCUMENTS

| | | | |
|---|---|---|---|
| 3,734,627 | 5/1973 | Edwards | 33/286 |
| 3,782,832 | 1/1974 | Hacskaylo | 356/153 |
| 3,787,693 | 1/1974 | Stone | 356/153 |
| 4,057,905 | 11/1977 | Piaja | 33/234 |
| 4,136,956 | 1/1979 | Eichweber | 356/153 |
| 4,750,269 | 6/1988 | Townsend et al. | 33/234 |
| 4,773,164 | 9/1988 | Taylor et al. | 33/234 |
| 4,825,258 | 4/1989 | Whitson | 33/234 |
| 5,001,836 | 3/1991 | Cameron et al. | 33/234 |
| 5,060,391 | 10/1991 | Cameron et al. | 33/234 |

*Primary Examiner*—Richard A. Rosenberger

[57] ABSTRACT

Apparatus for boresighting firearms which utilizes a number of commercially available laser gun sights as a light source. The system includes both fixed and adjustable bore adapters as well as fixed and adjustable laser sight mounts. Fixed bore adapters are designed for specific calibers. Adjustable bore adapters will function over a wide range of calibers. Fixed laser sight mounts will work only for laser gun sights of a specific diameter. Adjustable laser sight mounts will function with laser gun sights of any diameter. Fixed laser sight mounts may be utilized with adjustable bore adapters and fixed bore adapters may be used with adjustable laser sight mounts.

2 Claims, 4 Drawing Sheets

APPARATUS FOR LASER ASSISTED FIREARM SIGHTS ALIGNMENT

BACKGROUND

1. Field of Invention

This invention relates generally to a device for aligning the sights on firearms utilizing the boresighting technique. More specifically, it relates to a bore adapter and laser sight mounting assembly which can utilize one of several commercially available laser light beam sighting devices.

2. Description of Prior Art

Before a firearm can be fired with any accuracy, the sights must be aligned with the central axis of the bore of the weapon. This process is commonly referred to as boresighting. Weapons that can be "broken down" so that the full extent of the bore is visible, are sighted by looking down the bore at a point some distance from the weapon, usually a target. Then the sights on the weapon are adjusted so they roughly correspond to the same point on the target. Finally, the weapon is fired several times, and fine adjustments are made. Weapons which can't be broken down are simply anchored then fired and adjusted until the sights are reasonably close to the spot where the bullet impacts the target. This is a laborious and expensive process. With optical scopes, infrared or laser sights, the process must be repeated each time the firearm receives a jolt or the sighting devices are moved or replaced.

Several types of devices have been developed which attempt to facilitate this process. One type includes an internal laser light emitter. It fits into the firearm chamber and directs a beam of light through firearm bore and onto a target. The scope may be aligned with the target using either visual sighting or a second fight emitting device mounted on the scope. An example of this system is illustrated in U.S. Pat. No. 3,782,832 entitled METHOD OF BORESIGHT ALIGNMENT OF A WEAPON, issued Jan. 1, 1974 to Hacskaylo. However, as with the previously described device, slight misalignment of the housing within the chamber will cause relatively large errors in the alignment of the bore with the target. Also, a laser fight emitter must be custom built for each caliber or firearm, making this device expensive for the average gun owner or military unit in the field who may possess firearms of several different caliber.

U.S. Pat. No. 5,001,836, issued Mar. 26, 1991 to Cameron et al, entitled APPARATUS FOR BORESIGHTING A FIREARM also includes a cartridge which fits into the chamber of a firearm. However, the light emitting device is external to the cartridge and light is fed to the cartridge via a fiber optic element. The device also includes a system of lenses and another light emitting source external to the firearm contained in a box or the like. Similar to U.S. Pat. No. 5,060,391 also issued Oct. 29, 1991 to Cameron et al. These apparatuses would be expensive and unwieldy to carry into the field, since they could be easily damaged if dropped. Also these devices are only designed for aligning optical sights.

U.S. Pat. No. 4,136,956 issued Jan. 30, 1979 to Eichweber, entitled INTEGRATED ATTACHING AND ALIGNING APPARATUS FOR LASER DEVICES IN GUN BARRELS utilizes a custom-designed laser light which fits into a tubular unit which is inserted into the muzzle of a firearm. The tubular unit is retained in the barrel by resilient material rings which will deteriorate over time due to contact with residual solvents and oils present in the barrel. This will cause the device to become misaligned. It also requires a custom-built laser light emitter, making the device expensive.

OBJECTS AND ADVANTAGES

Several objects and advantages of the present invention are:

(a) To provide a rugged, lightweight sighting aid for either military or civilian applications.

(b) To provide a device which is applicable for telescopic, laser, and open or aperture iron sights as well as night vision sighting devices.

(c) To provide a device which is applicable to use on rifles, pistols and machine guns.

(d) To provide an economical system for aligning all firearms owned by a gun owner or assigned to a military unit in the field in less time and without the necessity of firing round after round of ammunition. A typical collector could purchase fixed bore adapters for each caliber of firearm in his collection or one adjustable bore adapter, and would need only one mount and one laser beam sight in order to adjust the sighting devices for those weapons.

(e) To provide a device which will not scratch or mat the bore of a firearm.

(f) To provide bore adapters which always align with the axis of the bore. The adjustable bore adapter prongs are controlled with a single spring and automatically align the bore adapter with the central axis of the barrel. The fixed adapters would be fashioned for a specific caliber and would be aligned with its axis.

The advantages and novel features of the present invention will become more readily apparent from the following detailed drawings taken in conjunction with the detailed description.

REFERENCE NUMERALS IN DRAWINGS

| | |
|---|---|
| 20 fixed bore adapter | 22 bore prongs |
| 24 mounting shaft | 26 bore stop |

-continued

| | |
|---|---|
| 28 muzzle groove | 30 fixed laser sight mount |
| 32 fitting socket | 34 laser control wire slot |
| 36 laser sight socket | 40 set screw |
| 50 laser light emitter | 52 laser sight control wires |
| 60 firearm | 61 laser mount guide slots |
| 62 laser mount elliptical driver slots | 63 laser mount adjustment tabs |
| 70 adjustable laser sight mount assembly | 71 laser mount guide disk |
| 72 laser sight grips | 73 laser mount driver disk |
| 74 laser mount resilient gripping pads | 75 laser mount spring |
| 76 laser mount spring cap retainer | 77 laser mount spring cap |
| 78 laser mounting shaft | 79 laser mount grip retainers |
| 81 bore adapter guide slots | 82 bore adapter elliptical slots |
| 83 bore adapter adjustment tabs | 90 adjustable bore adapter assembly |
| 91 bore adapter guide disk | 92 adjustable bore prongs |
| 93 bore adapter driver disk | 94 bore prong retainers |
| 95 bore adapter spring cap | 96 bore adapter spring cap retainer |
| 97 bore adapter spring | 98 adjustable bore adapter mounting shaft |

DESCRIPTION OF THE PREFERRED EMBODIMENT

Figure 1:
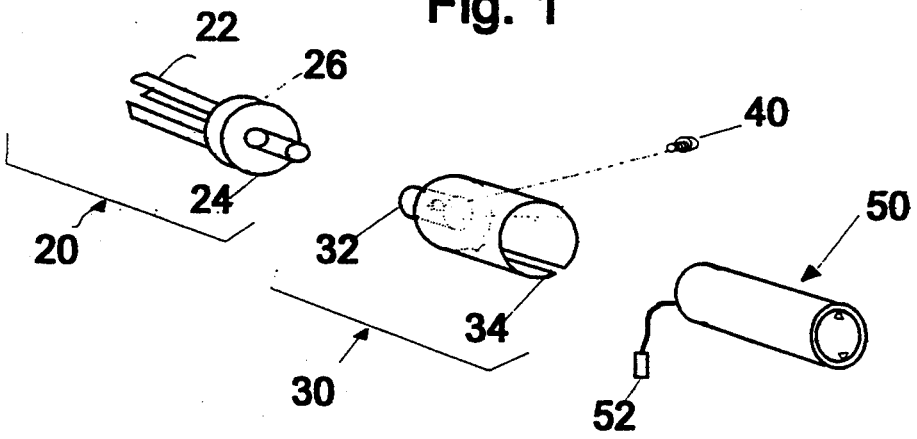
FIG. 1 is a perspective view of the of the fixed laser sight mount and the fixed bore adapter, along with a laser beam projection unit which could be utilized with the system.
Figure 4:
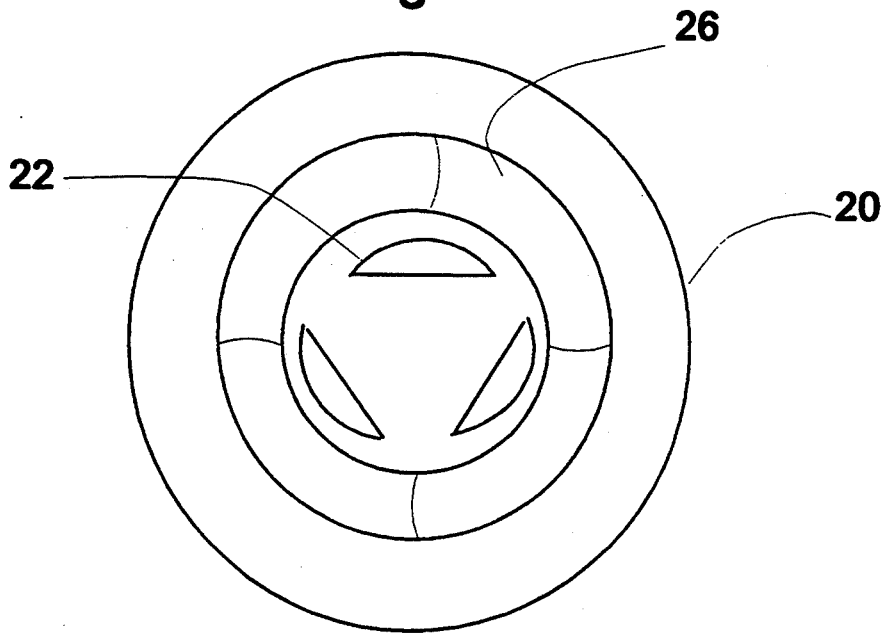
FIG. 4 is a plan view of the rear of the fixed bore adapter.

Referring to the drawings, wherein corresponding components are designated by the same reference numerals throughout the various figures. FIG. 1 illustrates a fixed bore adapter 20 having three prongs 22 which slide into a firearm barrel 60 and in concert with a muzzle stop 26, provide support for a laser sight mount 30 and a laser light emitter 50. FIG. 4 illustrates a rear-view of adapter 20 showing muzzle stop 26. A muzzle-groove 28 provides additional support by fitting around the curved end of a firearm muzzle. FIG. 4 also shows a cross-sectional view of prongs 22 illustrating their semi-circular shape which provides additional contact area within a bore.

Figure 2:
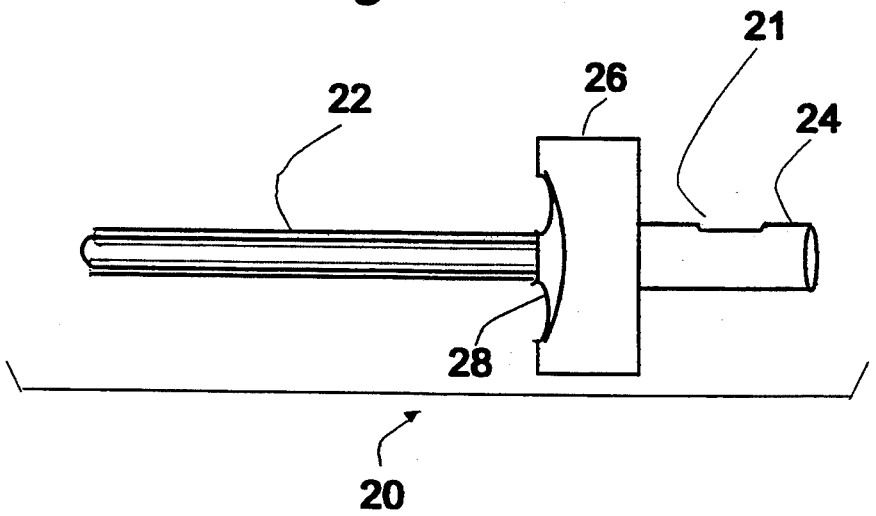
FIG. 2 is a side view of the fixed bore adapter.
Figure 3:
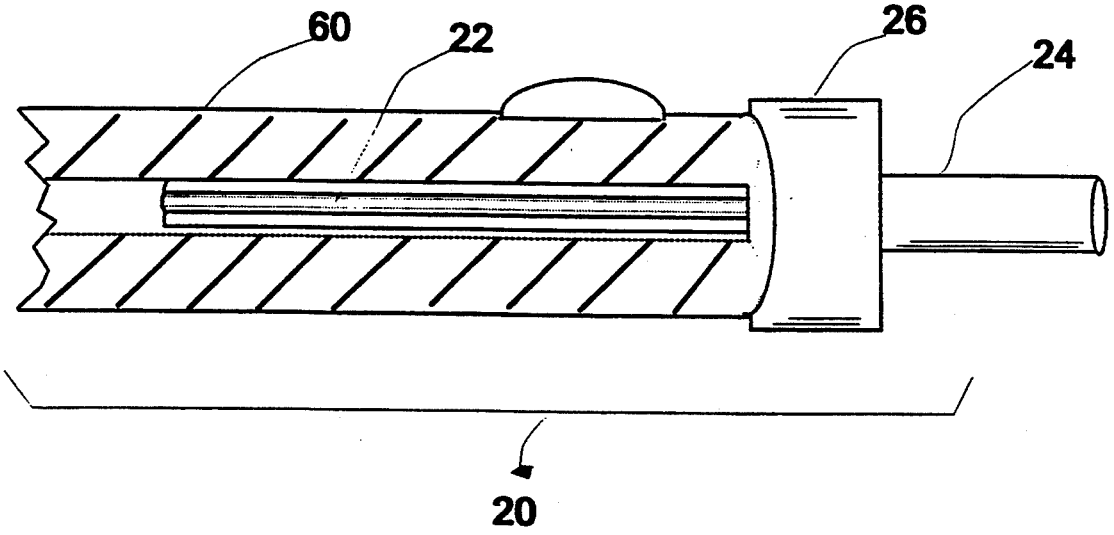
FIG. 3 is a side view of the fixed bore adapter within a rifle barrel.

Bore adapter 20 will be finished in such manner as to eliminate the possibility of damaging a firearm bore or muzzle with repeated insertions. FIG. 2 shows a side view of adapter 20. FIG. 3 illustrates a cutaway view of adapter 20 inserted into a firearm barrel 60. Bore adapters will be designed to fit the bore of each caliber of firearm i.e. 30—30, 38, 40 or 45.

Figure 5:
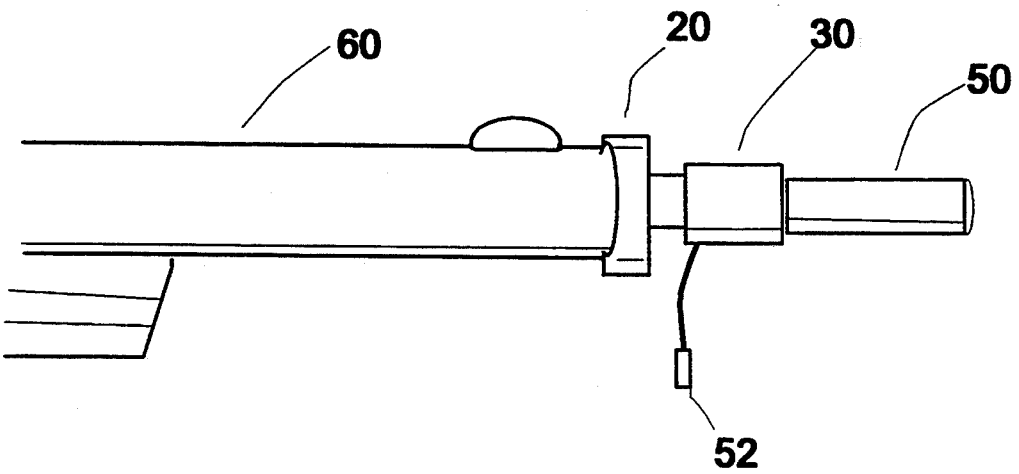
FIG. 5 is a side view of the fixed bore adapter, fixed laser sight mount and a laser beam projection unit within a rifle barrel.

In FIG. 1 laser sight mount 30 is affixed to a mounting shaft 24 of bore 20 and held in place by a set screw 40. Laser sight mount 30 accepts laser light emitter 50 with a slot 34 accepting laser control wires 52. FIG. 5 illustrates a typical assembly inserted in a firearm barrel 60 including laser light emitter 50.

The bore adapter and mount can be manufactured from metallic alloys, plastics, or any composite material which will be rugged, lightweight and resist deformation under extreme conditions. Ferrous alloys can be utilized for the adapter 20 to ensure a stronger hold on firearm barrel 60 by magnetizing the assembly.

Figure 7:
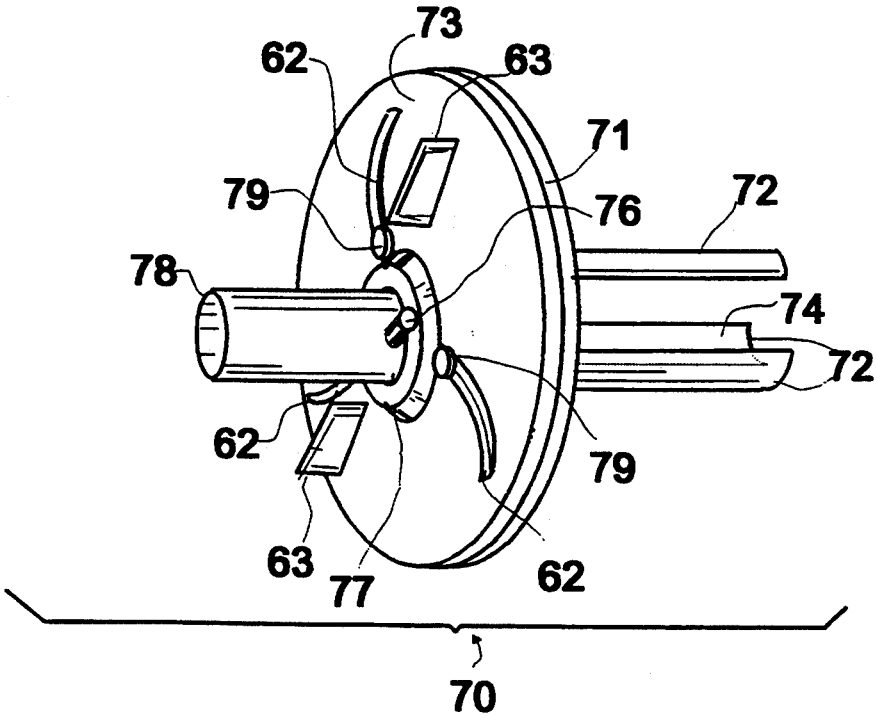
FIG. 7 is an assembled view of the adjustable laser sight mount.
Figure 9:
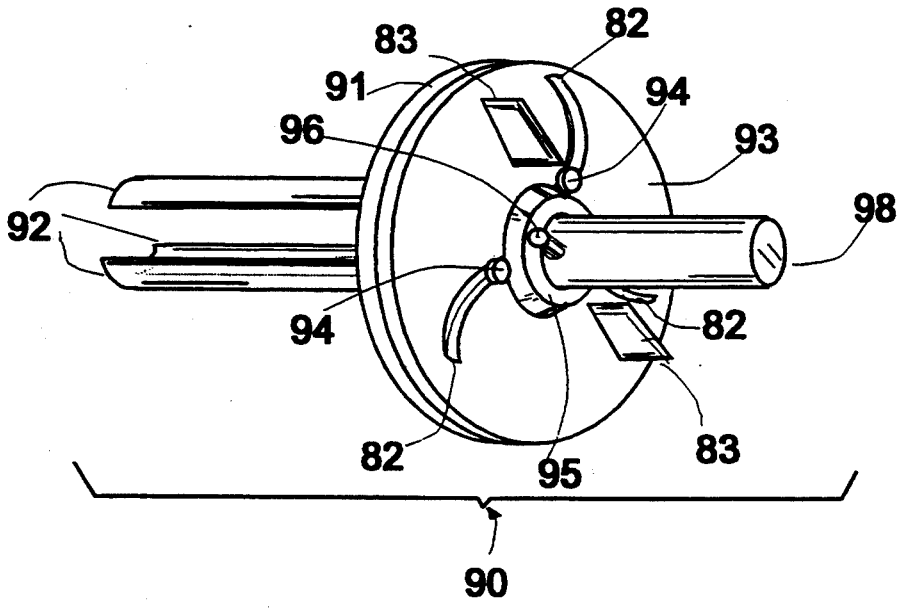
FIG. 9 is an assembled view of the adjustable bore adapter.

An adjustable bore adapter FIG. 9 and an adjustable laser sight mount FIG. 7 are also provided for in the present invention and may be used together or in conjunction with fixed bore adapters or laser mounts. For instance, the adjustable bore adapter could be utilized in conjunction with a fixed laser sight mount, providing a single bore adapter which could fit the bore of several different calibers of firearms.

Figure 6:
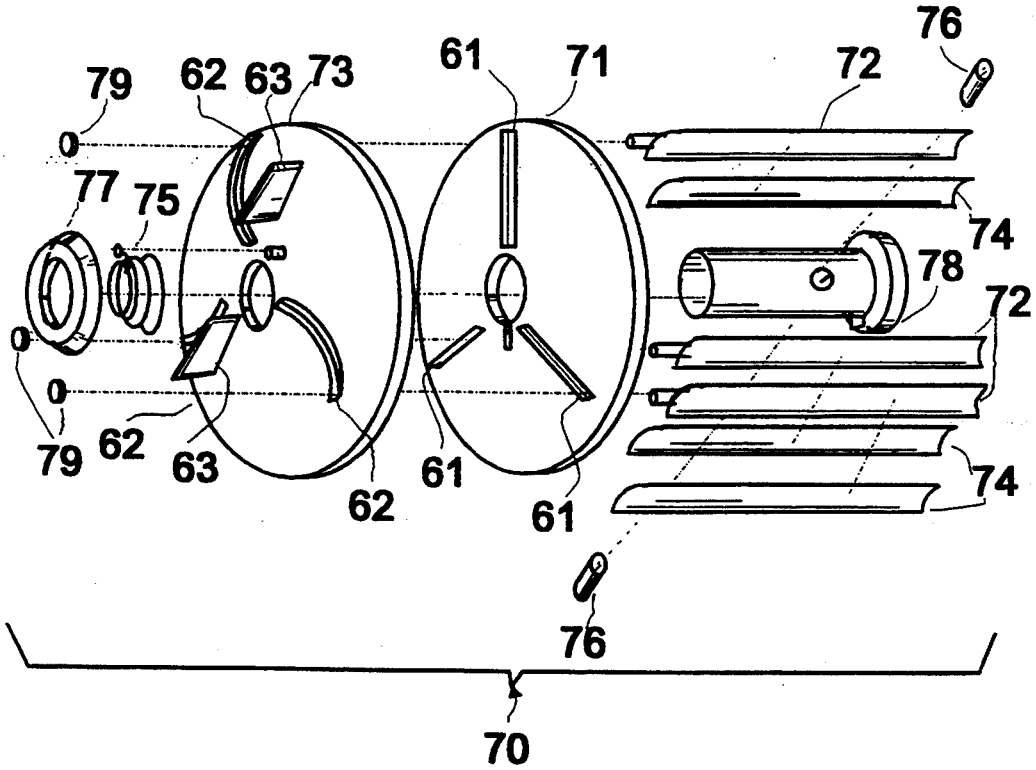
FIG. 6 is an exploded view of the adjustable laser sight mount.

FIG. 7 illustrates an adjustable embodiment of a laser sight mount assembly 70. When laser mount adjustment tabs 63 are rotated counter clockwise, laser mount driver disk 73 rotates on laser mounting shaft 78. Laser mount elliptical driver slots 62 force laser sight grips 72 to slide outward in laser mount guide slots 61 of laser mount guide disk 71. When tabs 63 are released, laser mount spring 75 rotates disk 73 clockwise causing grips 72 to return to the center of the assembly. Spring 75 is protected by a laser mount spring cap 77 and the assembly is held together by laser mount cap retainers 76. Laser grip retainers 79 hold grips 72 in place. Resilient gripping pads 74 are affixed to inward facing surface of grips 72 using adhesive. FIG. 6 illustrates an exploded view of adjustable laser sight mount 70.

Figure 8:
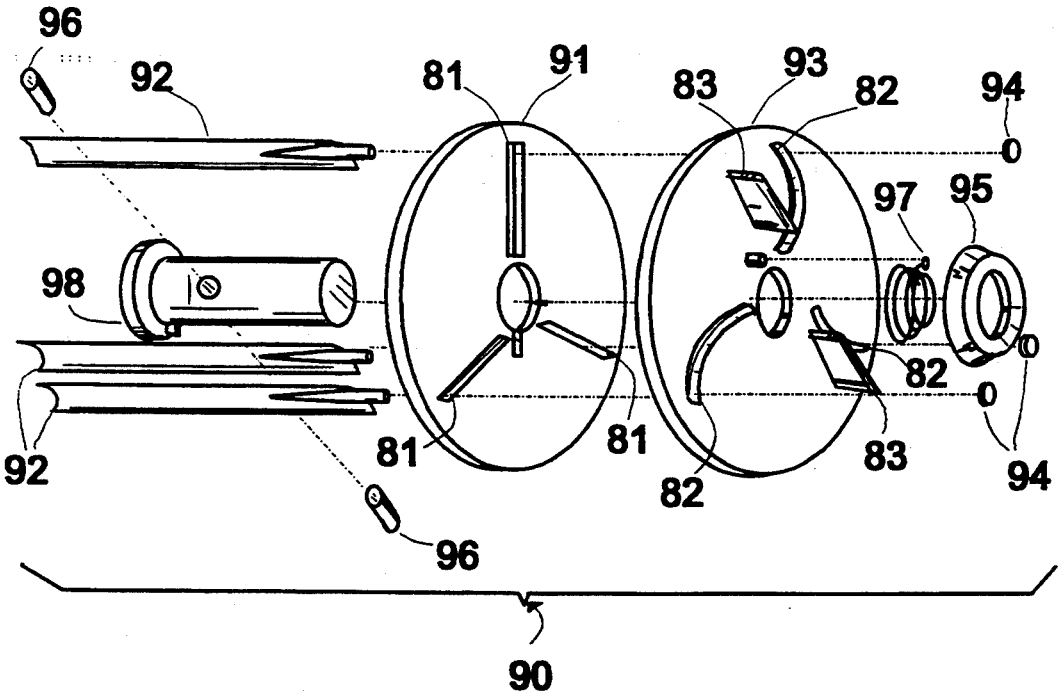
FIG. 8 is an exploded view of the adjustable bore adapter.

FIG. 9 illustrates an adjustable embodiment of a bore adapter assembly 90. When bore adapter adjustment tabs 83 are rotated clockwise, a bore adapter driver disk 93 rotates on an adjustable bore adapter mounting shaft 98. Bore adapter elliptical driver slots 82 force adjustable bore prongs 92 to slide inward in bore adapter guide slots 81 of a bore adapter guide disk 91. When tabs 83 are released, a bore adapter spring 97 rotates disk 93 counter clockwise, causing prongs 92 to slide outward. Spring 97 is protected by a bore adapter spring cap 95. Assembly 90 is held together by bore adapter spring cap retainers 96. Bore prong retainers 94 hold prongs 92 in place. FIG. 8 illustrates an exploded view of assembly 90.

OPERATION—FIGS. 1,2,4,5,7,9,10

As shown in FIG. 1, to operate the present invention, select a magnetized bore adapter 20 for the caliber of firearm to be boresighted. Select a laser sight mount 30 for laser light emitter to be used. Slide fitting socket 32 over bore adapter mounting shaft 24 of bore adapter 20. Tighten set screw 40. Thread laser sight control wires 52 into laser control wire slot 34 of fixed laser sight mount 30. Insert laser light emitter 50 into sight mount 30. Insert bore prongs 22 of magnetized bore adapter 20 into bore of firearm 60, making certain muzzle groove 28 of bore stop 26 fits snugly over end of muzzle. With assembly firmly seated within muzzle, laser light emitter 50 will align precisely with axis of bore.

To operate adjustable laser sight mount FIG. 6 and 7, rotate laser mount adjustment tabs 63 counter clockwise. The laser mount driver disk 73 will rotate. The laser mount elliptical driver slots 62 will force the laser sight grips 72 to slide outward in laser mount guide slots 61 of laser mount guide disk 71. Insert laser light emitter 50 into area between laser sight grips 72, making certain control wire 52 fits between grips 72 and release tabs 63. Laser mount spring 75 causes grips 72 to contract toward center of assembly, clamping onto laser fight emitter and holding it along the linear axis of laser sight mount assembly 70. Resilient gripping pads 74 adhere to laser light emitter 50 so that it doesn't slip from device.

To operate adjustable bore adapter 90 FIG. 8 and 9, rotate bore adapter adjustment tabs 83 clockwise. Bore adapter driver disk 93 will rotate, causing bore adapter elliptical slots 82 to force adjustable bore prongs 92 inward. Insert prongs 92 into bore of firearm and release tabs 83. Bore adapter spring 97 will force prongs 92 outward, centering bore adapter 90 axially within bore.

Figure 10:
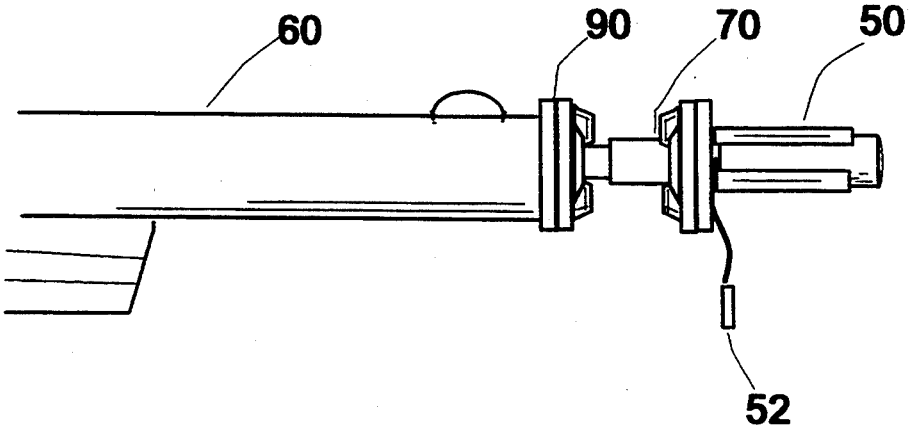
FIG. 10 is a side view of a laser light emitter, adjustable laser sight mount, and an adjustable bore adapter within a firearm barrel.

Slide laser mounting shaft 78 of adjustable laser sight mount 70 over adjustable bore adapter mounting shaft 98 of bore adapter 90. Tighten set screw 40. FIG. 10 illustrates assembled adjustable bore adapter 90 and adjustable laser sight mount 70.

Using laser control wires 52, switch on laser light emitter 50. Aim firearm at a target. Anchor the firearm to a table or other rest with a vice, rifle stand, sandbags or the like. Adjust the sights to correspond to the spot on the target where the laser light beam appears. Remove the bore adapter laser sight mount assembly from the firearm. Load a round into the firearm and test fire to determine if sights are properly correlated with the path of the bullet.

CONCLUSION, RAMIFICATIONS AND SCOPE

Accordingly, the reader will see that the apparatus is uncomplicated and the parts are few. The present invention can be manufactured of sturdy materials. Furthermore, the device has the following advantages.

It can be easily stored.

It is lightweight and can be carried into the field for hunters or military units.

It provides flexibility by permitting the use of many types of laser sights.

It is inexpensive because by permitting the use of many types of laser gun sights, even laser pointers may be used for adjusting sights for shorter distances. The least expensive alternative may be selected.

It is easy and inexpensive to upgrade, since purchasing a firearm of a different caliber only requires the purchase of another fixed bore adapter, not an entire assembly including laser beam emitter. If the adjustable bore adapter has been purchased, no additional hardware would be necessary.

For the same reason. Purchasing a different type of laser light emitter will not obsolete the assembly, since only another laser sight mount needs to be purchased.

If an adjustable laser sight mount and an adjustable bore adapter were purchased, no additional equipment would be necessary if a new laser light emitter or another caliber firearm were purchased.

All laser sight mounts may be used with all bore adapters so that the most economic and advantageous combination may be selected by the buyer.

Although the description above contains many specificities, these should not be construed as limiting the scope of the invention but as merely providing illustrations of some of the presently preferred embodiments of this invention. For example, the shape of the bore stop could be square or some other shape to accommodate different firearms, the shape of the driver disk and guide disk could be flattened on one side to accommodate different fixed sights; the bore adapter could be manufactured of a composite or other material and could also be universally adaptable to firearms of several different calibers.

Thus the scope of the invention should be determined by the appended claims and their legal equivalents, rather than by the examples given.

I claim:

1. Adjustable apparatus for boresighting said firearm for accurate alignment of adjustable firearm sights with the axis of the barrel of said firearm, comprising:

an adjustable bore adapter assembly, comprising;

(a) a plurality of adjustable bore prongs;

(b) manual adjustment means wherein said adjustable bore prongs are manually contracted for insertion into said firearm muzzle;

(c) spring means wherein said adjustable bore prongs are forced outward with equal pressure in all directions to center said bore adapter assembly within axis of said barrel when said manual adjustment means are released;

(d) a bore adapter mounting shaft for attachment to an adjustable laser sight mount;

said adjustable laser sight mount assembly, comprising;

(e) a plurality of adjustable laser sight grips;

(f) manual adjustment means wherein said adjustable laser sight grips are manually expanded outward for insertion of said laser light emitter;

(g) a spring means wherein said adjustable laser sight grips are retracted in order to grasp said laser light emitter when said manual adjustment means are released;

attachment means to unite said adjustable bore adapter assembly with said adjustable laser sight mount.

2. Apparatus as set forth in claim 1 wherein said adjustable laser sight grips are lined with laser mount resilient gripping pads which prevent said laser light emitter from slipping.

* * * * *